US005111876A

United States Patent [19]

Nash

[11] Patent Number: 5,111,876

[45] Date of Patent: May 12, 1992

[54] HEAT EXCHANGER PLATE FIN

[75] Inventor: Eric J. Nash, Manlius, N.Y.

[73] Assignee: Carrier Corporation, Syracuse, N.Y.

[21] Appl. No.: 786,203

[22] Filed: Oct. 31, 1991

[51] Int. Cl.[5] ..... F28F 1/30

[52] U.S. Cl. ..... 165/151; 165/110; 165/181; 165/913; 62/290

[58] Field of Search ..... 165/110, 111, 151, 181, 165/182, 913; 62/288, 290

[56] References Cited

U.S. PATENT DOCUMENTS

| | | | |
|---|---|---|---|
| 1,557,467 | 10/1925 | Modine | 165/151 |
| 3,796,258 | 3/1974 | Malhotra et al. | 165/151 |
| 3,902,551 | 9/1975 | Lim et al. | 165/111 |
| 4,860,822 | 8/1989 | Sacks | 165/151 |
| 5,056,594 | 10/1991 | Kraay | 165/151 |

FOREIGN PATENT DOCUMENTS

| | | | |
|---|---|---|---|
| 123949 | 7/1931 | Austria | 165/913 |
| 2398279 | 3/1979 | France | 165/151 |
| 61-243294 | 10/1986 | Japan | 165/151 |

*Primary Examiner*—Allen J. Flanigan

[57] ABSTRACT

A plate fin (12) for a plate fin and tube heat exchanger (10) used in an application in which the tubes run generally horizontally and in which condensation of a vapor entrained in the air flowing over and around the plate fins and tubes is likely to occur. The plate fin is configured to promote efficient and effective drainage of condensate that forms on the fin during heat exchanger operation. The fin is sinusoidally corrugated and has raised lance elements. There is a corrugated drainage channel section (32) between each vertical pair of adjacent fin collars (17). The drainage channel sections provide a path for condensate to run down the vertical plate fin to the bottom of the heat exchanger. By facilitating condensate drainage, the drainage channel sections serve to reduce the tendency of condensate to blanket the plate fins and tubes and interfere with air flow around the plate fins and the external surfaces, thus promoting heat transfer between the fluids flowing inside and outside the heat exchanger tubes.

6 Claims, 3 Drawing Sheets

HEAT EXCHANGER PLATE FIN

BACKGROUND OF THE INVENTION

This invention relates to plate fin and tube heat exchangers used in air conditioning, refrigeration and other applications. More particularly, the invention relates to an improved plate fin for use in a heat exchanger in which condensation of a vapor entrained in the gaseous fluid flowing over the exterior of the tubes and plate fins is likely.

Plate fin and tube heat exchangers are used in a wide variety of applications in which it is desired to exchange heat between two fluids, usually a pure liquid or a liquid undergoing a phase change to or from a gas, flowing in the heat exchanger tubes and a gas, usually air, flowing around the heat exchanger plate fins and tube exteriors. In such a heat exchanger, a plurality of thin plate fins are arranged parallel to each other between two tube sheets. Heat exchanger tubes pass through holes in the tube sheets and plate fins. There is a firm fit between the tubes and the plate fins so that the effective surface area, and thus the heat transfer area, of the heat exchanger tubes is increased by the area of the plate fins. Because of this increase in surface area, a plate fin and tube heat exchanger offers improved heat transfer performance over a plain tube type heat exchanger of the same size.

Prior art designers have devised numerous plate fin configurations. The configurations developed have attempted to improve the heat transfer performance of a given plate fin in two primary ways: (1) by maximizing, within the limits of the heat exchanger external dimensions, the plate fin surface area in contact with the fluid flowing around the fins; and (2) by configuring the fin in such a way as to minimize the thickness of the heat transfer inhibiting boundary layer on the external surfaces of the fin. One means of increasing the fin surface area is to corrugate the fin so that, for a given fin spacing, more fin surface area can be fit into the same volume. Corrugation also promotes conditions that minimize boundary layer thickness.

Another means of minimizing boundary layer thickness is to configure the fins with louvers or lances. A louver is a raised portion of the fin formed by first making a single slit into the fin and then raising the fin material on one side of the slit. A lance is a raised portion of the fin formed by first making two slits into the fin and then raising the fin material between the slits.

U.S. Pat. No. 4,860,822 (Sacks, Aug. 29, 1989) describes a heat exchanger plate fin that incorporates more than one type of heat transfer performance enhancement. The Sacks fin is corrugated in a sinusoidal pattern, with raised lance elements formed into the surface of the fin.

In some applications, there may be a gaseous fluid having an entrained vapor flowing around the tubes and plate fins and conditions in the heat exchanger may be conducive to condensation of the vapor. An example of such an application is the evaporator in an air conditioning system. Indeed, one function of an air conditioning evaporator is to condense moisture from the air passing through it. A heat exchanger designed for use in an application where vapor condensation may occur must provide for effective and efficient drainage of condensate from the tubes and plate fins. If condensate cannot quickly drain off, it will build up on and blanket the exterior surfaces of the tubes and fins, thus reducing heat transfer and also increasing the air flow resistance of the heat exchanger.

Surface enhancements on a plate fin such as louvers and lances may inhibit drainage of condensate from the fin, as surface tension effects may cause condensate droplets to bridge between the edges of the louver or lance and the main body of the fin, causing surface blanketing and interfering with the function of the surface enhancement.

Thus a plate fin designed for use in an environment where the fluid flowing over the tubes and fins is completely gaseous may not perform well in an environment in which condensation of entrained vapor occurs on the fin.

SUMMARY OF THE INVENTION

The present invention is a plate fin, for use in a plate fin and tube type heat exchanger having tubes oriented generally horizontally, of an improved configuration that promotes efficient and effective drainage of condensate that may form on the plate fins and exterior of the tubes. The invention is intended for use in heat exchangers in which condensation of a vapor entrained in the gaseous fluid passing over and around the tubes and plate fins is likely.

A plate fin constructed according to the teaching of the present invention has an overall sinusoidal corrugation so as to increase the total fin surface in the heat exchanger, within the constraints of fluid flow considerations and the overall dimensions of the heat exchanger, as well as to minimize the thickness of the boundary layer in the fluid flowing over the fins and the exterior surfaces of the tubes. Raised lance elements are located at certain of the points of maximum curvature of the overall sinusoidal corrugation. There are no raised lance elements located between pairs of vertically adjacent fin collars. Instead, the overall sinusoidal fin corrugation is interrupted by a second sinusoidal corrugation having a shorter wavelength than the overall corrugation. The configuration of the second sinusoidal corrugation is so as to form channels for the drainage of liquid that may condense on the tubes and plate fins. The presence of the drainage channels in place of raised lance elements between vertically adjacent fin collars promotes condensate drainage, inhibits the collection of condensate on the fin surfaces and thus promotes efficient heat transfer between the fins and the air flowing through the heat exchanger and at the same time minimizing air flow resistance.

BRIEF DESCRIPTION OF THE DRAWINGS

The accompanying drawings form a part of the specification. Throughout the drawings, like reference numbers identify like elements.

DESCRIPTION OF THE PREFERRED EMBODIMENTS

Figure 1:
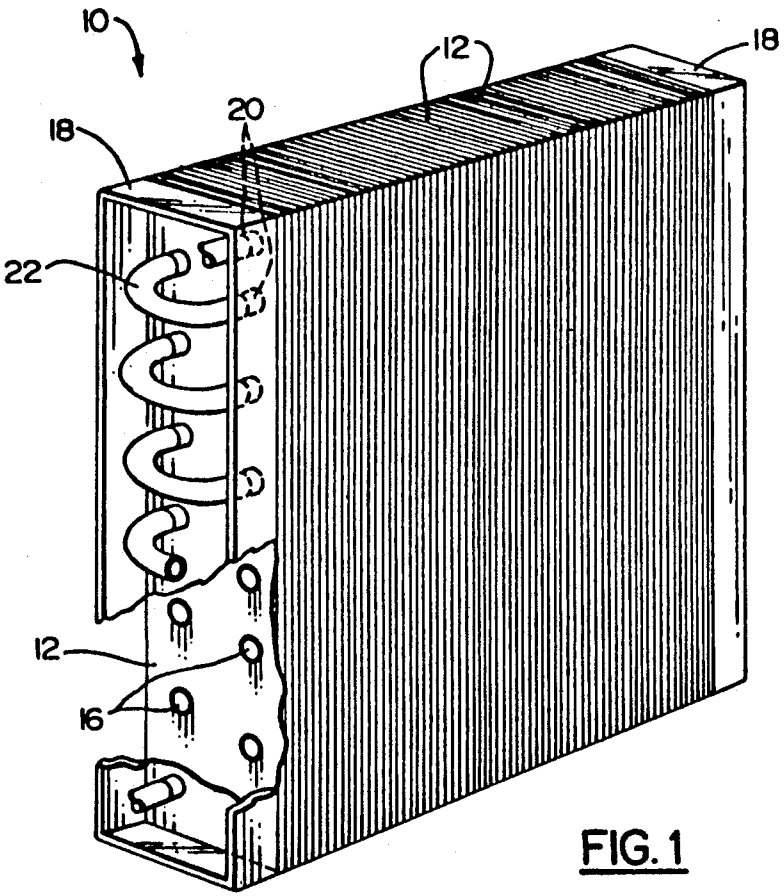
FIG. 1 is a pictorial view, partly broken away, of a plate fin and tube heat exchanger containing embodiments of the present invention.

FIG. 1 depicts plate fin and tube heat exchanger 10 containing plate fins 12 that embody the present invention. Each plate fin has a plurality of holes 16. A common method of manufacturing heat exchanger 10 is to first assemble a plurality of plate fins 12 between two tube sheets 18, then lace a plurality of hairpin tubes 20 through selected holes 16 in the plate fins 12 and similar holes in each of tube sheets 18, then form bells in the ends of hairpin tubes 20, then expand the legs of the tubes to insure a tight mechanical fit between the tubes and plate fins. The heat exchanger assembly is completed by fitting up a plurality of return bends 22 to the belled ends of hairpin tubes 20 so as to form one or more closed fluid flow paths through the tubes of the heat exchanger.

When installed and operating in a device such as an air conditioner, a first fluid, such as a refrigerant, flows through heat exchanger 10 via a fluid flow path or paths defined by interconnected hairpin tubes 20 and return bends 22. A second fluid, such as air, flows over and around plate fins 12 and tubes 20. If there is a temperature differential between the two fluids, then heat transfer from the warmer to the cooler of the two takes place through the tube walls and plate fins.

FIG. 1 illustrates a heat exchanger having two staggered rows of holes in its plate fins and tube sheets. The present invention may be embodied in plate fins used in heat exchangers of other configurations, from a single row arrangement to one with multiple rows and having tube holes that are staggered or not staggered.

Figure 2:
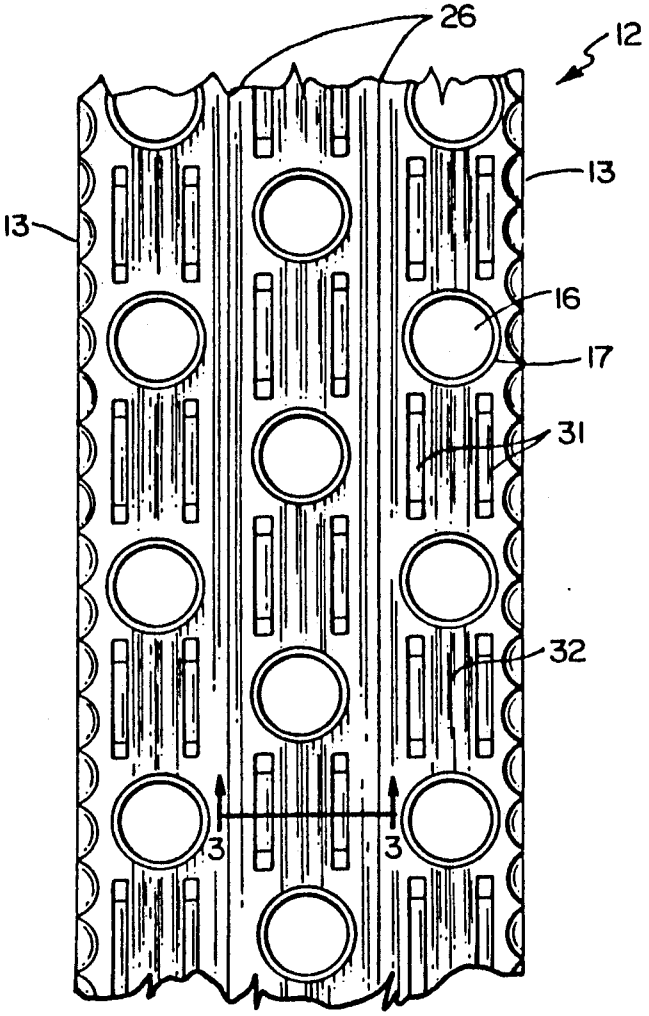
FIG. 2 is an elevation view of a portion of an embodiment the present invention.

FIG. 2 illustrates, in elevation view, a portion of an embodiment of the present invention in which plate fin 12 is of the three row staggered tube type. The fin has a plurality of tube holes 16 through it. Between each vertically adjacent pair of tube holes 16 are two raised lance elements 31 and a drainage channel section 32. Surrounding each tube hole 16 is a fin collar 17. Between each vertical row of tube holes 16 is an inter-row space 26. The fin has two edges 13.

Figure 3:
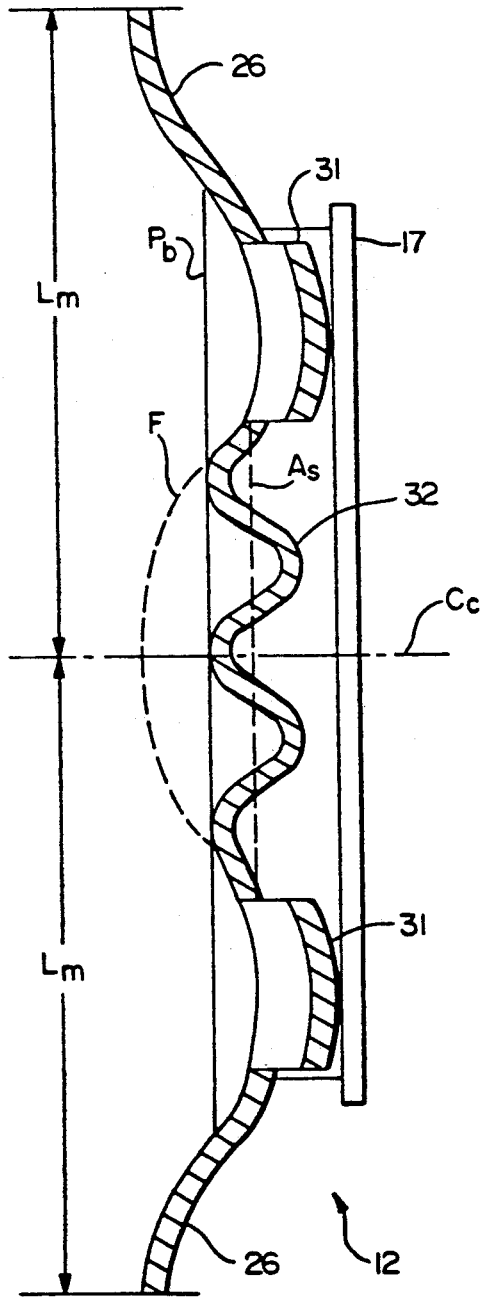
FIG. 3 is an elevation view of a section, through line III—III in FIG. 2, of an embodiment of the present invention.

FIG. 3 is an elevation view of a section, through line III—III, of the embodiment of the present invention depicted in FIG. 2. Extending out from one side of plate fin 12 is fin collar 17. By the length to which they extend from the surface of the fin, the plurality of fin collars 17 serve to determine the spacing between the plurality of plate fins 12 in heat exchanger 10. The plurality of fin collars 17 also function to assure that there is sufficient area of contact and a close mechanical fit, and therefore good thermal conductivity, between the plate fins and the tubes.

Associated with plate fin 12 is fin collar base plane $P_b$. One surface of the flat sheet feedstock from Which plate fin 12 is manufactured is coincident with fin collar base plane $P_b$. Plate fin 12 has an overall sinusoidal corrugation of wavelength $L_m$ that runs perpendicular to both edges 13 (FIG. 2) and centerline $C_c$ of fin collar 17. There are generally two corrugation wavelengths per row of tube holes.

Lance elements 31 are raised from plate fin 12 on the same side of the fin from which fin collar 17 extends and are located at the points of maximum deflection of the sinusoidal corrugation from fin collar base plane $P_b$ in the same direction that fin collar 17 extends, those points also being points of maximum curvature of the corrugation.

Between the two lance elements 31 and adjacent fin collar 17, plate fin 12 has a second corrugation of a shorter wavelength forming drainage channel section 32. This second corrugation replaces the overall corrugation, indicated by dashed line F, in the drainage channel section. The second sinusoidal corrugation has axis of symmetry $A_s$ that may be parallel to or lie in fin base plane $P_b$.

Figure 4A:
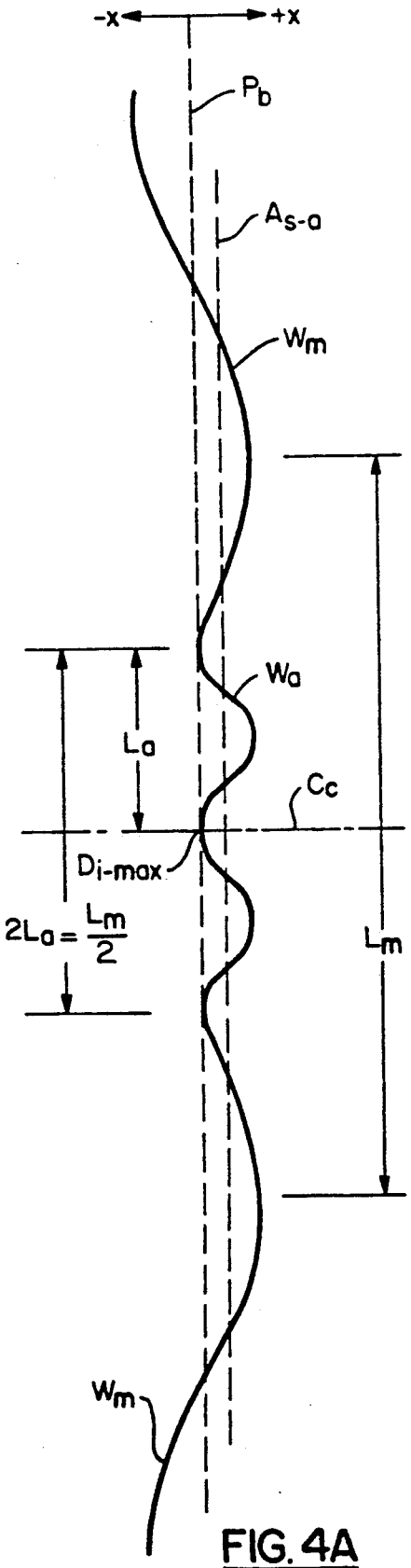
FIGS. 4A through 4C are depictions of three different composite waveforms that respectively define the cross sectional configuration of three different embodiments of the present invention.
Figure 4B:
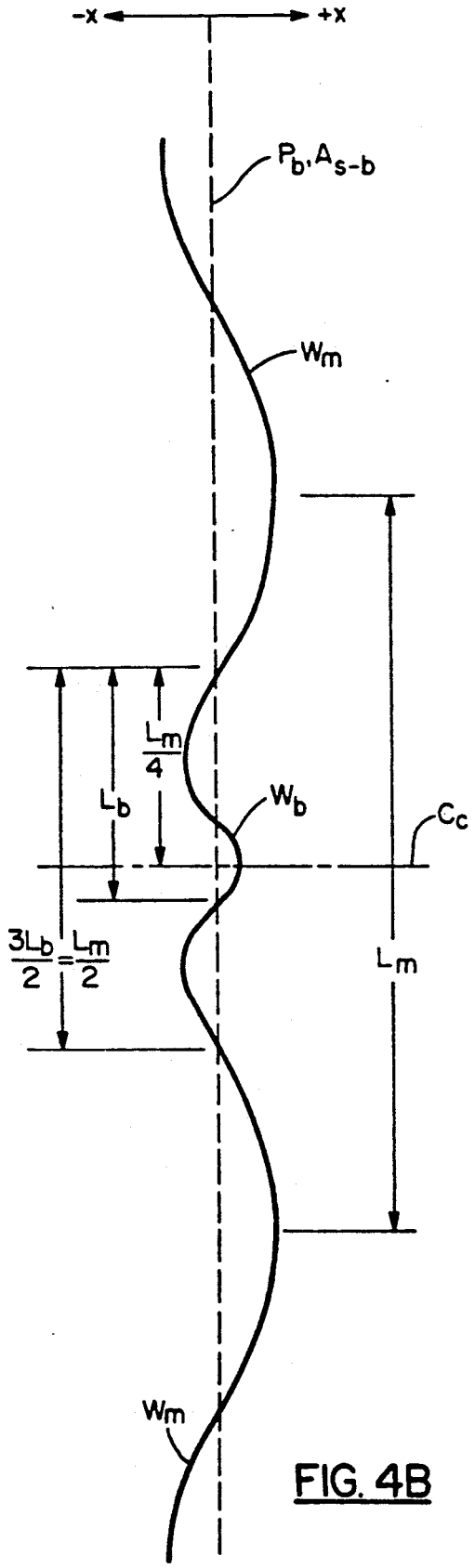
Figure 4C:
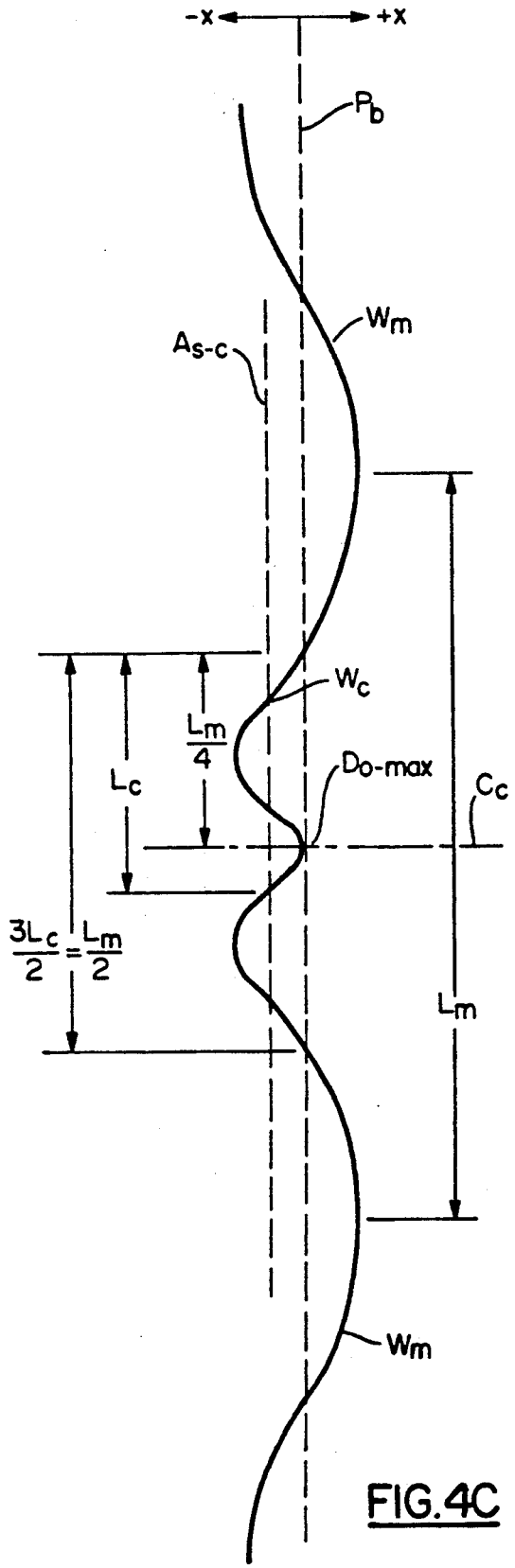

FIGS. 4A through 4C depict three different composite sinusoidal waveforms that define respectively the planforms of three different embodiments of the plate fin of the present invention. The three embodiments differ only in the configuration of the sinusoidal drainage channel section of the fin. Each of FIGS. 4A through 4C depict a fin planform having sinusoidal main corrugation $W_m$ with wavelength $L_m$. Each of the figures also show fin collar base plane $P_b$ and common centerline $C_c$ of a row of fin collars. Arbitrary indicators of direction $+x$ and $-x$ define the direction of displacement from base plane $P_b$. Fin collars on a plate fin having one of the three planforms depicted would extend in the $+x$ direction from the fin collar base plane.

The planform of one embodiment of the present invention is similar to that depicted in FIG. 4A, with the planform of the drainage channel section being similar to waveform $W_a$. Waveform $W_a$ is two cycles of wavelength $L_a$, which is one fourth of main corrugation wavelength $L_m$, centered on common centerline $C_c$. Axis of symmetry $A_{s-a}$ of waveform $W_a$ is displaced in the $+x$ direction from fin collar base plane $P_b$ so that point of maximum inward displacement $D_{i-max}$ of waveform $W_a$ in the $-x$ direction lies in fin collar base plane $P_b$. The FIG. 4A planform is the planform of the embodiment depicted in FIG. 3.

The planform of another embodiment of the present invention is similar to that depicted in FIG. 4B, with the planform of the drainage channel section being similar to waveform $W_b$. Waveform $W_b$ is one and one half cycles of wavelength $L_b$, which is one third of main corrugation wavelength $L_m$, centered on common centerline $C_c$. Axis of symmetry $A_{s-b}$ of waveform $W_b$ lies in fin collar base plane $P_b$.

The planform of a third embodiment of the present invention is similar to that depicted in FIG. 4C, with the planform of the drainage channel section being similar to waveform $W_c$. Waveform $W_c$ is one and one half cycles of wavelength $L_c$, which is one third of main corrugation wavelength $L_m$, centered on common centerline $C_c$. Axis of symmetry $A_{s-c}$ of waveform $W_c$ is displaced in the $-x$ direction from fin collar base plane $P_b$ so that point of maximum outward displacement $D_{o-max}$ of waveform $W_c$ in the $+x$ direction lies in fin collar base plane $P_b$.

Note that the term "sinusoidal" used in the above description of the plate fins of the present invention means that the waveforms of the fin may be either true sine curves or "sine-like," e.g. approximations of a true sine curve. Design requirements and practical considerations inherent in preparing tooling and in manufacturing the fins mean that the waveforms may not necessarily be mathematically rigorous sine curves.

A plate fin embodying the teaching of the present invention may be made of any suitable material, such as aluminum or copper.

What is claimed is:

1. An improved plate fin (12) for a plate fin and tube heat exchanger (10), said plate fin having an edge (13), a first side, a second side, a fin collar base plane, a row of circular fin collars (17) having a common centerline that is parallel to said edge with each fin collar extending outward from said first side and from said fin collar base plane and a main corrugation, sinusoidal in a plane perpendicular to said edge and having a first wavelength and a first axis of symmetry that lies in said base plane, in said fin, the improvement comprising:

elongated lance elements (31), each having a longer dimension that is parallel to said edge, raised outward from said first side at points of maximum displacement of said fin outward from said base plane; and corrugated drainage channel sections (32), sinusoidal in said perpendicular plane and having a second wavelength and a second axis of symmetry parallel to said base plane, between pairs of adjacent fin collars in said row, replacing said main corrugation in said fin for one half said first wavelength.

2. The plate fin of claim 1 in which said second wavelength is one fourth said first wavelength.

3. The plate fin of claim 2 in which said second axis of symmetry is displaced outward from said base plane in a direction that is the same as the direction said fin collars extend so that a point of maximum displacement of said corrugated drainage channel sections inward toward said second side lies in said base plane.

4. The plate fin of claim 1 in which said second wavelength is one third said first wavelength.

5. The plate fin of claim 4 in which said second axis of symmetry lies in said base plane.

6. The plate fin of claim 4 in which said second axis of symmetry is displaced inward from said base plane in a direction opposite to the direction said fin collars extend so that a point of maximum displacement of said corrugated drainage channel sections outward and in the same direction as said fin collars extend lies in said base plane.

* * * * *